US006604649B1

(12) United States Patent
Campi

(10) Patent No.: US 6,604,649 B1
(45) Date of Patent: Aug. 12, 2003

(54) CONTAINER FOR THE THERMOSTATIC PRESERVATION OF LIQUIDS

(75) Inventor: Edoardo Maria Campi, Valdagno (IT)

(73) Assignee: Agnoplast di Campi Dottor Dino E.C.-S.N.C., Valdagno (IT)

( * ) Notice: Subject to any disclaimer, the term of this patent is extended or adjusted under 35 U.S.C. 154(b) by 0 days.

(21) Appl. No.: 09/980,022

(22) PCT Filed: May 22, 2000

(86) PCT No.: PCT/EP00/04633

§ 371 (c)(1),
(2), (4) Date: Feb. 19, 2002

(87) PCT Pub. No.: WO00/75042

PCT Pub. Date: Dec. 14, 2000

(30) Foreign Application Priority Data

Jun. 4, 1999 (IT) ..... VI99A0114

(51) Int. Cl.[7] ..... B65D 25/00
(52) U.S. Cl. ..... 220/739; 220/592.17; 220/903
(58) Field of Search ..... 220/739, 592.17, 220/592.24, 903

(56) References Cited

U.S. PATENT DOCUMENTS

| | | | | |
|---|---|---|---|---|
| 3,120,319 A | | 2/1964 | Buddrus | |
| 3,779,298 A | | 12/1973 | Piccirilli et al. | |
| 3,905,511 A | * | 9/1975 | Groendal | 220/903 X |
| 4,228,908 A | | 10/1980 | Tweeton | |
| 4,561,563 A | * | 12/1985 | Woods | 220/592.17 |
| 4,615,463 A | * | 10/1986 | Price et al. | 220/592.17 |
| 4,872,577 A | * | 10/1989 | Smith | 220/903 X |
| 6,039,207 A | * | 3/2000 | Adamek | 220/739 |
| 6,155,452 A | * | 12/2000 | Laurent | 220/739 |

FOREIGN PATENT DOCUMENTS

| | | |
|---|---|---|
| DE | 26 16 502 A | 10/1977 |
| FR | 2588248 A | 4/1987 |
| FR | 2597444 A | 10/1987 |
| FR | 2697148 A | 4/1994 |

* cited by examiner

*Primary Examiner*—Steven Pollard
(74) *Attorney, Agent, or Firm*—R. Neil Sudol; William Sapone; Henry Coleman

(57) ABSTRACT

A container for the thermostatic preservation of liquids, to be used particularly for leisure, sport and for infants, including a shell (8), formed by two coupled portions (9, 10), and forming a cavity (11) for accommodating a vessel (12) which contains the liquid. The shell is made of thermally insulating and impact-resistant material. The invention fully solves the problems of conventional containers, since it achieves a thermostatic preservation of liquids whose duration can be compared to that of thermos flasks and at the same time protects the vessel against any external aggressive agents, such as dust, insects and so forth.

8 Claims, 5 Drawing Sheets

CONTAINER FOR THE THERMOSTATIC PRESERVATION OF LIQUIDS

TECHNICAL FIELD

The present invention relates to a container for the thermostatic preservation of liquids, particularly but not exclusively useful in leisure, sport and with infants.

BACKGROUND ART

It is known that there are many types of vessels which allow to store liquids in general at a constant temperature for a certain period of time. In particular, so-called thermos flasks are very popular among people who practice sports, especially in the mountains. It is well-known that these flasks are double-walled glass or metal vessels with an empty air space, in which a beverage such as water, coffee, white coffee, juice et cetera is placed in order to keep it hot or cold for a rather long time. However, most currently commercially available beverages are contained in their own package, which can be an ordinary bottle or a can for beer or soft drinks in general, or a box-like plastic-coated paper package for juices, dairy products such as milk, yoghurt and so forth. Clearly, in order to place these beverages in thermos flasks it is necessary to transfer the content of the package to the thermos flask. In order to obviate this need, vessels shaped like a cylindrical cup of various sizes, made of Insulating material, are commercially available, and a can or bottle can be inserted directly therein. Another aspect of the prior art related to this field consists, for example, in preparing warm food to be given to children or in the preservation and transport of certain types of drugs, which often have to be kept at temperatures below 0° C. For example, U.S. Pat. No. 4,228,908 discloses an insulated baby bottle carrier.

A first drawback of the abovedescribed first type of conventional vessels is that the packages, and correspondingly the beverage contained therein, are only partially protected against heat exchange with the environment, since the end portion of the packages, on which the opening is arranged, is unprotected. In this case, it is evident that the duration of the thermostatic preservation of the beverage is considerably shorter than the duration obtainable with thermos flasks.

A second drawback of these containers is that they do not protect the region that surrounds the opening against dirt and insects, especially after the package has been opened.

A third drawback is that the purchaser of these containers is forced to carry them by hand or in a bag, because they have no grip members suitable for carrying them comfortably.

A first drawback related to the other aspects of the prior art is that, warm foods such as milk are often poured into glass containers, for example bottles for baby feeding, which have no thermal insulation of any kind. Accordingly, such foods must be given immediately and it is not possible to transport them so as to keep their temperature unchanged. The same drawback arises in the case of drugs when they are given by the pharmacist to the customer. Clearly, along the route from the drugstore to the buyer's home, the medicines are unlikely to be kept at the same temperature conditions in which they were delivered.

DISCLOSURE OF THE INVENTION

The aim of the present invention is to overcome the drawbacks noted above in conventional insulating containers for packages of beverages, by providing a container for the thermostatic preservation of liquids which allows complete insulation of the vessel and, of course, of the beverage contained therein, with respect to the outside environment, simultaneously with an effective protection of the vessel against any contaminants such as dirt, insects and so forth.

An object of the invention is to provide a container which can extend the thermostatic condition of the liquids contained therein for a duration which is comparable to that of thermos flasks.

Another object of the invention is to provide a container which can be adapted to the different shapes and dimensions of the several commercially available packages of beverages, foods, medicines, et cetera.

Another object of the invention is to provide a container which is non-toxic, easy and handy to carry, completely washable and can be recycled rather easily to a significant extent.

This aim, these objects and others which will become apparent hereinafter are achieved by a container for the thermostatic preservation of liquids, characterized in that it comprises a shell, formed by at least two coupled portions, which forms at least one cavity for accommodating at least one vessel which contains the liquids.

BRIEF DESCRIPTION OF THE DRAWINGS

Further characteristics and advantages of the present invention will become apparent from the following detailed description of a preferred but not exclusive embodiment thereof, illustrated only by way of non-limitative example in the accompanying drawings, wherein.

Ways of carrying out the invention.

Figure 3:
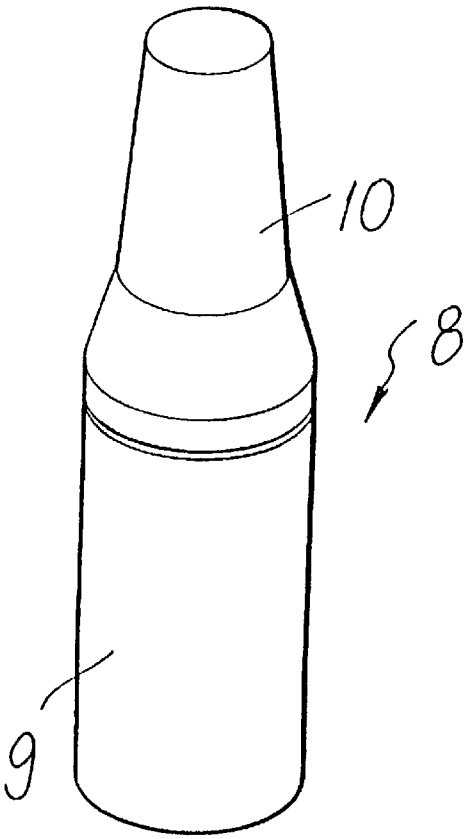
FIG. 3 is a perspective view of a container for bottles, according to the invention.
Figure 2:
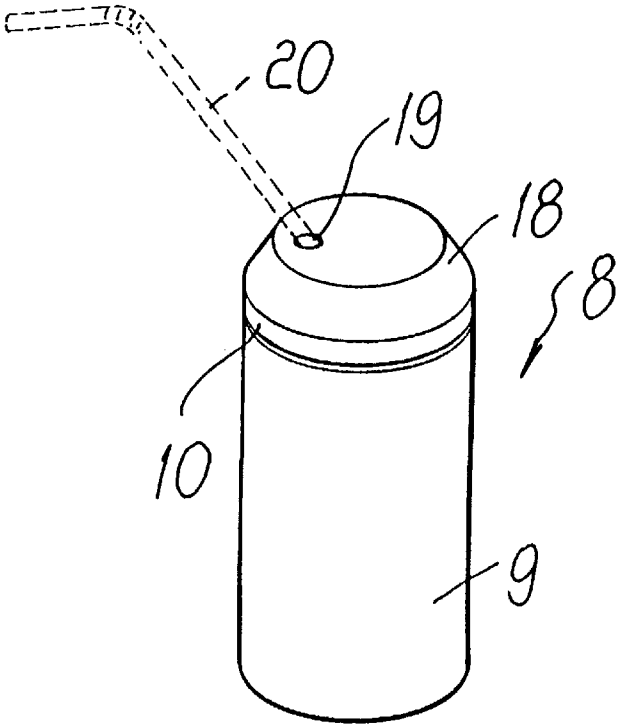
FIG. 2 is a perspective view of another container for cans, according to the invention.
Figure 1:
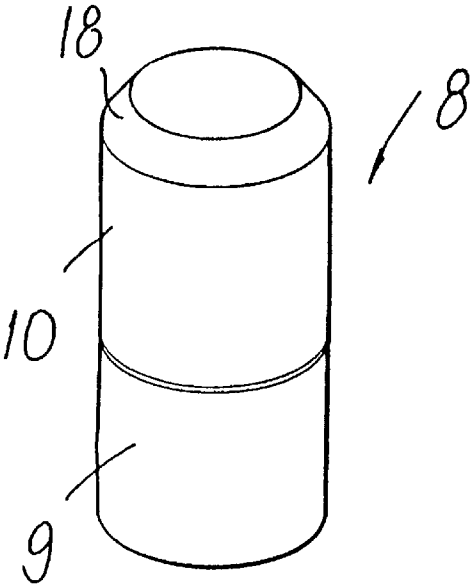
FIG. 1 is a perspective view of a container for cans, according to the invention.
Figure 4:
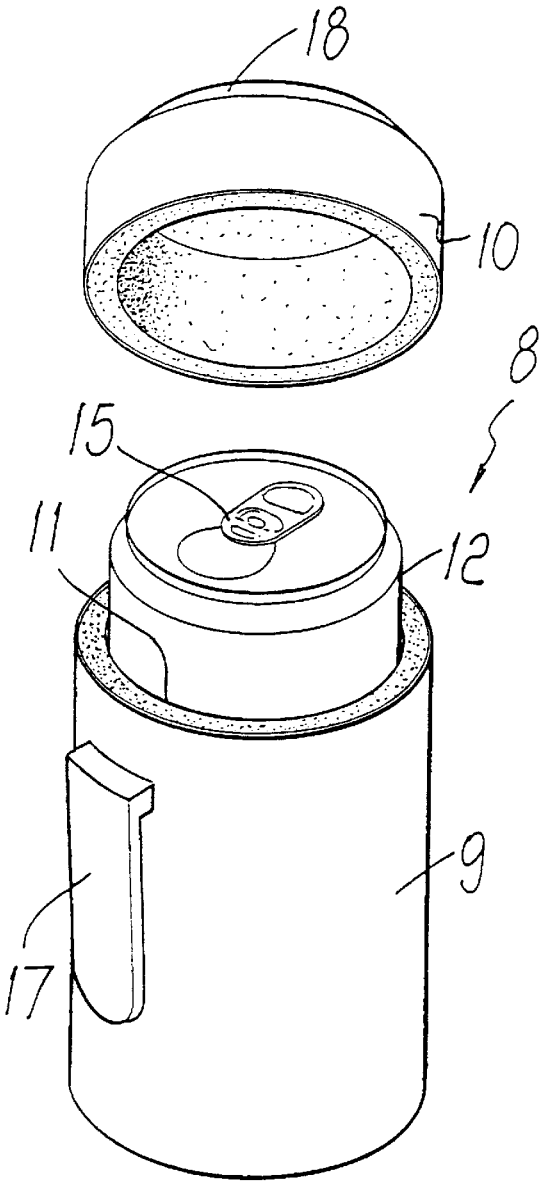
FIG. 4 is an exploded view of the container of FIG. 2.
Figure 6:
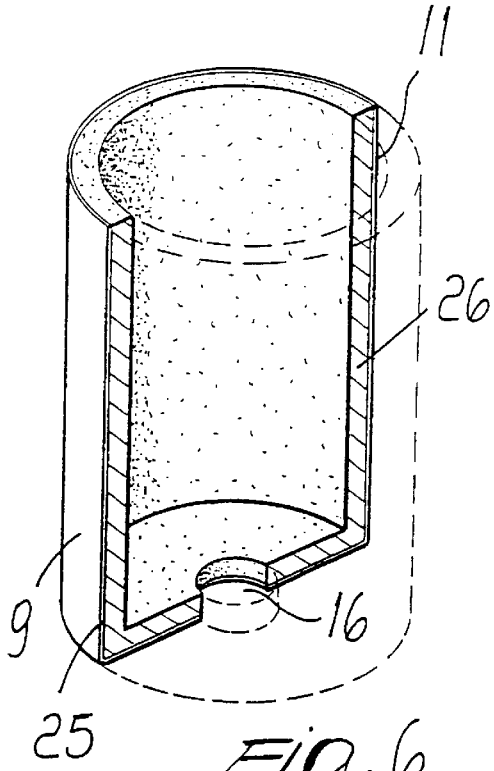
FIG. 6 is a sectional view, taken along an axial plane, of part of the container of FIG. 4.
Figure 5:
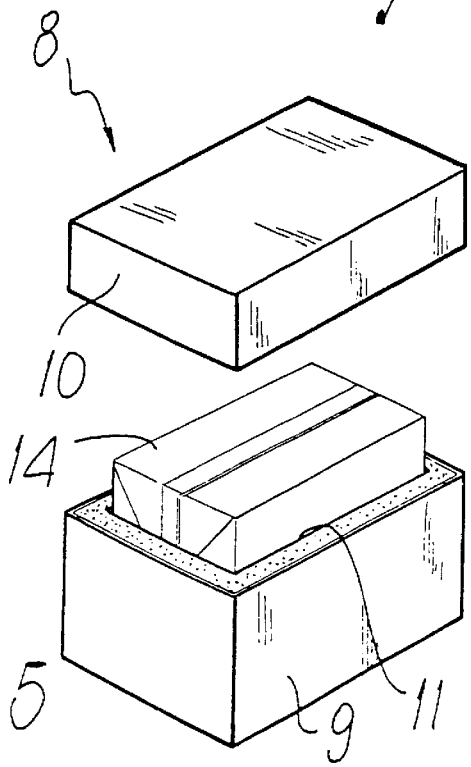
FIG. 5 is an exploded view of a container for packages of dairy products, juices and the like, according to the invention.
Figure 7:
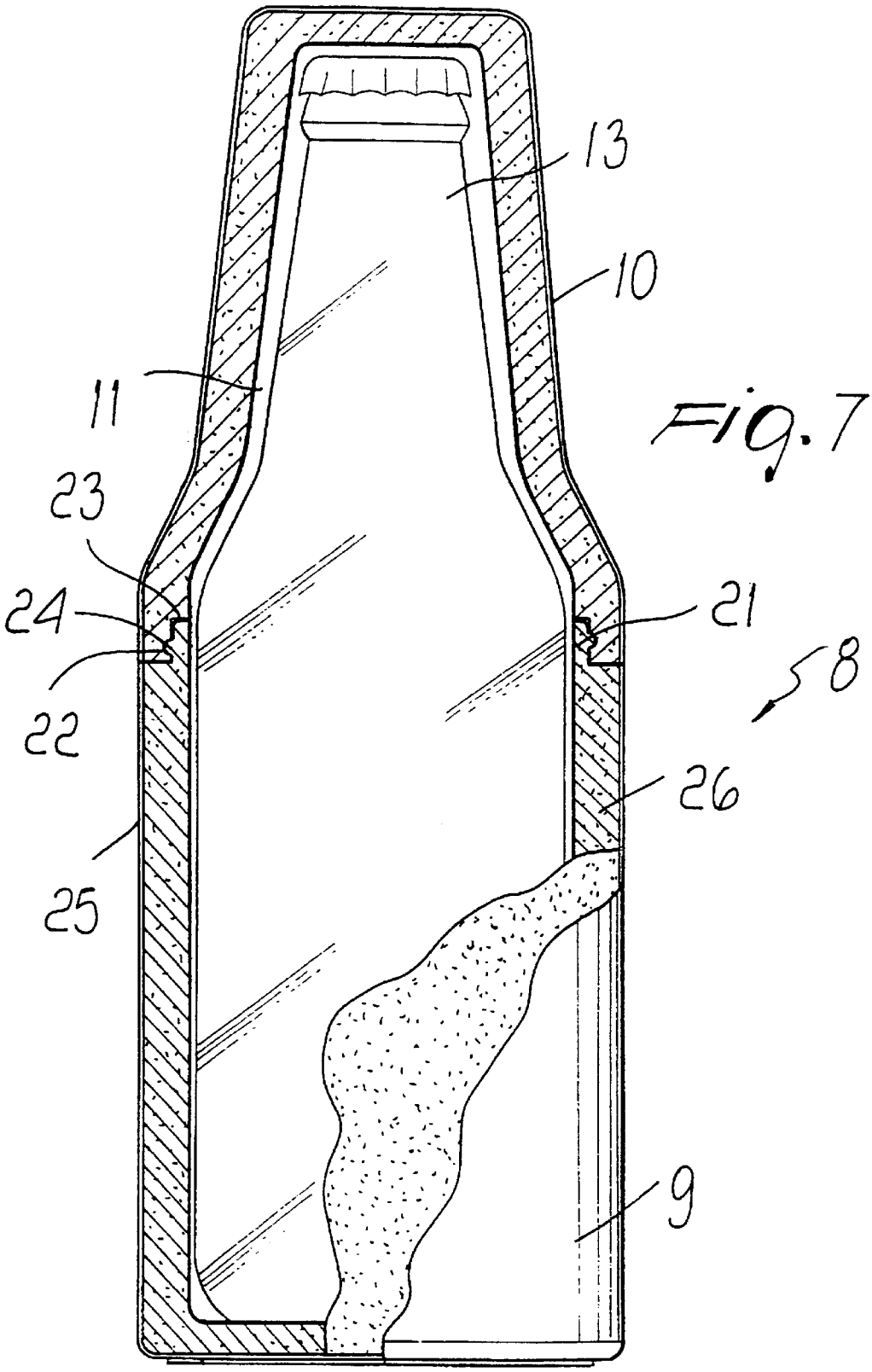
FIG. 7 is a sectional view, taken along an axial plane, of the container of FIG. 3.
Figure 8:
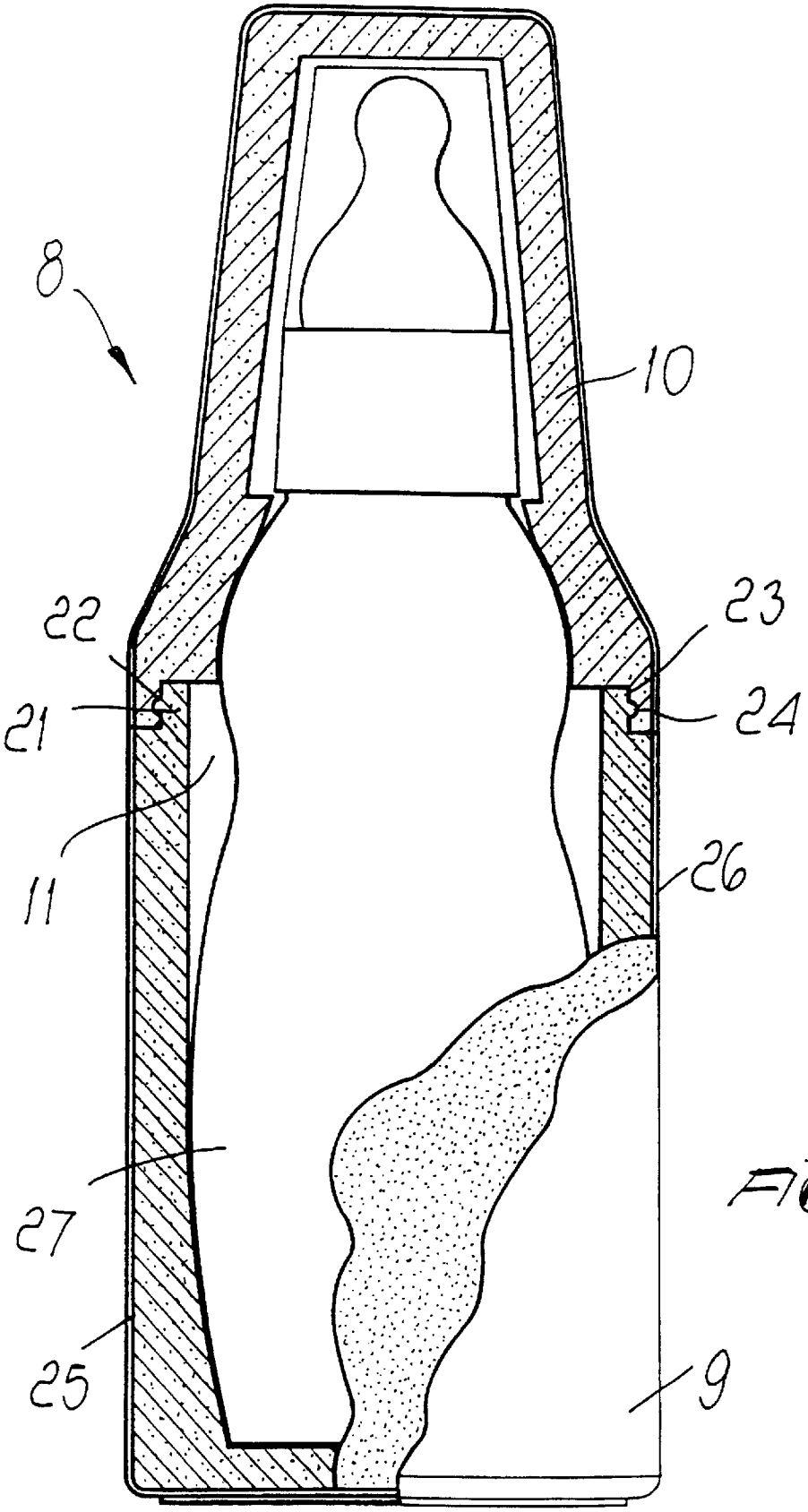
FIG. 8 is a sectional view, taken along an axial plane, of a container for a feeding bottle.
Figure 9:
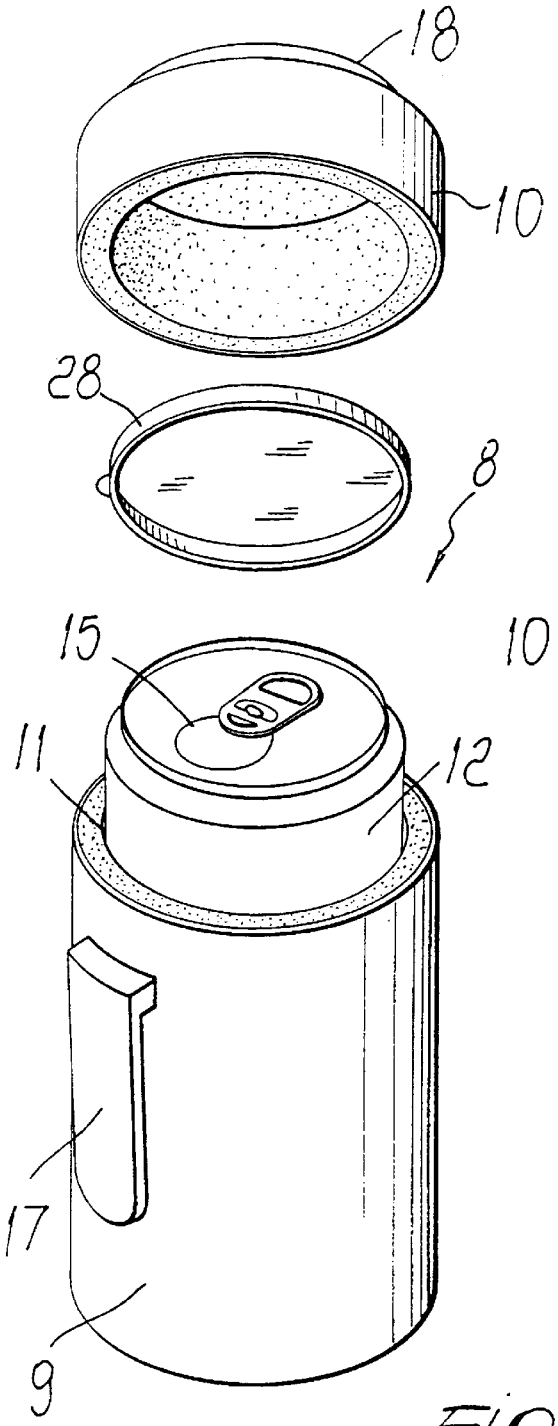
FIG. 9 is an exploded view, similar to FIG. 4, of a container for cans provided with a cap to be applied to the can.
Figure 10:
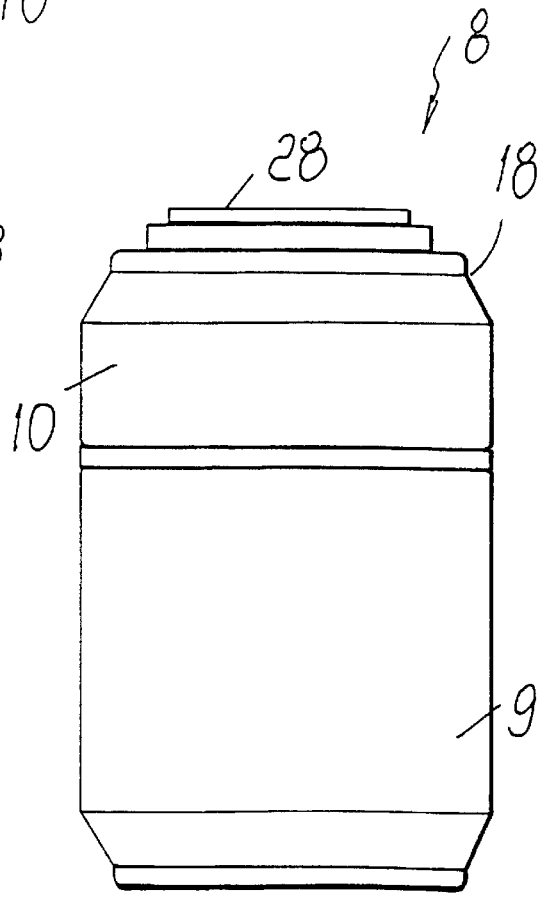
FIG. 10 is a perspective view of the container of FIG. 9, provided with a seat for the cap to be applied to the can.

With reference to the above figures, the container for the thermostatic preservation of liquids is substantially composed of a shell, generally designated by the reference numeral 8, which is formed by at least two portions, designated by the reference numerals 9 and 10 respectively, and forms a cavity 11 which is adapted to accommodate a vessel, i.e., a can 12 in the case of FIGS. 1, 2, 4, 9 and 10, a bottle 13 in the case of FIGS. 3 and 7, a prism-shaped package 14 in the case of FIG. 5, and a feeding bottle 27 in the case of FIG. 8. In detail, and with reference to FIGS. 1, 2, 4, 6, 9 and 10, the two portions 9 and 10 are cup-shaped so as to respectively accommodate the lower portion of the vessel and the upper portion, where the tear-open opening 15 is located. More specifically, the portion 9 preferably accommodates most of the body of the can 12, so that any permanent removal of the portion 10 does not excessively compromise the duration of the thermostatic preservation of the beverage. Conveniently, the insertion of the can 12 in the portion 9 occurs with a certain interference, so that the user cannot unintentionally extract the can 12 from the portion 9. In this case, in order to facilitate the extraction of the can 12 from the portion 9 once the beverage is finished, on the bottom of the portion 9 there is provided a central hole 16 through which one pushes with one finger against the bottom of the can 12. Moreover, the portion 9 is provided with a tab 17 which protrudes externally and parallel to the wall of the portion 9, in order to fasten the container, for example to the belt or waist of the trousers. In turn, the coupling between the can 12 and the portion 10 has less interference than the corresponding coupling between the portion 9 and the can 12, in order to facilitate the removal of the portion 10 in order to access the opening 15 of the can 12 without simultaneously compressing the portion 9. Additionally, the portion 10 has an annular chamfer 18 which allows the user to identify it immediately and at the same time makes it easier to grip. A peripheral hole 19 provided on the top of portion 10 allows to insert a straw 20 in the container, with reference to FIGS. 9 and 10, between the top of the can 12 and the portion 10 there is provided a hermetic cap 28 which can be coupled to the open can, so as to prevent liquid from escaping from it or so as to prevent, in the short term, the contents from losing their effervescent characteristics. When the can is closed and seated within the container 8, the cap 28 can be easily accommodated in a suitable circular compartment provided with a rim and formed in the top of the portion 10, as shown in FIG. 10. With reference to FIG. 5, the portions 9 and 10 are shaped like an approximately parallelepipedal box. Preferably, the portion 9 accommodates, for the already-noted reason, most of the container 14, which can contain milk, yogurt, medicines, and so forth. With reference to FIGS. 3 and 7, the portion 9 and the portion 10 respectively accommodate the cylindrical body and the neck of the bottle 13. In this case, the portion 10 is substantially shaped like a truncated cone, so as to follow the profile of the neck. The coupling between the portion 9 and 10 is achieved at the interface by screwing. In detail, the portion 9 is provided with an annular protrusion 21 along the edge of the wall of the portion 9 and with a raised portion 22 which runs in a helical pattern along the outer surface of the protrusion 21. Accordingly, the inner edge of the wall of the protrusion 21 has an annular recess 23 and a helical recess 24 in which the annular protrusion 21 and the raised portion 22 respectively engage. This coupling can of course be provided by means of a male-female interlocking coupling, or with similar methods, without thereby abandoning the scope of the invention. The container for the feeding bottle, shown in FIG. 8, is provided approximately in the same manner. In the illustrated embodiments, each one of the portions 9 and 10 is formed by two capsules, respectively designated by the reference numerals 25 and 26, which are mutually coupled inside each other. Preferably, the outer capsule 25 is considerably thinner than the inner capsule 26. Specifically, the outer capsule 25 is made of molded or blown plastics and the inner capsule 26 is made of foamed plastics, with heat-insulating characteristics, which is formed by molding, optionally with the addition of minute glass particles in order to increase its insulating power. In any case, the materials used can be recycled approximately to 80%. The coupling between the two caps 25 and 26 is achieved by slight interference at the interface or, if this is not provided, by interposing suitable adhesives.

In practice it has been observed that the container thus described achieves the intended aim and objects, by providing a thermostatic preservation of liquids whose duration can be compared to that of thermos flasks and at the same time protecting the vessel against any external aggressive agents. Moreover, the walls of the shell can be shaped in any manner and can have raised portions, patterns, et cetera, in order to give the container a particular aesthetic value. Finally, the container simultaneously has a highly advantageous impact-resistant function which is useful particularly for glass bottles.

The container according to the invention is susceptible of numerous modifications and variations, within the scope of the appended claims. All the details may be replaced with other technically equivalent elements.

In practice, the materials used, as well as the dimensions and the contingent shapes, may be any according to requirements. It is understood that the container may also accommodate vessels other than those shown, such as for example canteens, et cetera.

What is claimed is:

1. A container for the thermostatic preservation of liquids, comprising a shell formed by at least two coupled portions, said shell defining a cavity for accommodating at least one vessel which contains said liquids, wherein one of said portions is provided with a lateral protrusion which protrudes parallel to a wall of said one of said portions, and wherein another one of said portions is provided with a hermetic cap which can be coupled to a top of said vessel to close said vessel and can be accommodated, when the vessel is closed, in a seat which is provided with a rim and is formed on a top of said one of said portions.

2. The container according to claim 1, wherein one of said portions is provided with an annular chamfer which is adapted to identify it.

3. The container according to claim 1, wherein at least one of said portions is frustum-shaped so as to match the shape of the vessel.

4. The container according to claim 1, wherein the coupling of said portions to one another is achieved by mutually screwing said portions.

5. The container according to claim 1, wherein said portions have mutually facing edges, at least one of said edges being provided with an annular protrusion which is in turn provided with a helical raised portion which is formed externally, and the other one of said edges being provided with an annular recess and with a helical recess for engaging said annular protrusion and said helical raised portion.

6. The container according to claim 1, wherein each of said portions comprises two capsules which are mutually coupled, one inside the other, so as to form an outer capsule and an inner capsule, said outer capsule being thinner than said inner capsule.

7. The container according to claim 6, wherein said inner capsule has thermal insulation characteristics.

8. The container according to claim 6, wherein said outer capsule and said inner capsule are coupled with slight interference at the interface.

* * * * *